US010435982B2

(12) United States Patent
Shkurti et al.

(10) Patent No.: US 10,435,982 B2
(45) Date of Patent: Oct. 8, 2019

(54) DISSOLVABLE PLUG ASSEMBLY

(71) Applicant: Superior Energy Services, LLC, Harvey, LA (US)

(72) Inventors: Piro Shkurti, The Woodlands, TX (US); Gustavo Andrew Oliveira, Houston, TX (US); Iain Greenan, Houston, TX (US)

(73) Assignee: Superior Energy Services, LLC, Harvey, LA (US)

( * ) Notice: Subject to any disclaimer, the term of this patent is extended or adjusted under 35 U.S.C. 154(b) by 153 days.

(21) Appl. No.: 15/459,683

(22) Filed: Mar. 15, 2017

(65) Prior Publication Data

US 2017/0268310 A1 Sep. 21, 2017

Related U.S. Application Data

(60) Provisional application No. 62/309,225, filed on Mar. 16, 2016.

(51) Int. Cl.
*E21B 33/12* (2006.01)
*E21B 33/134* (2006.01)
*E21B 33/129* (2006.01)

(52) U.S. Cl.
CPC ..... *E21B 33/1208* (2013.01); *E21B 33/129* (2013.01); *E21B 33/134* (2013.01)

(58) Field of Classification Search
CPC .. E21B 33/1208; E21B 33/134; E21B 33/129; E21B 33/13; E21B 33/12; E21B 33/16
See application file for complete search history.

(56) References Cited

U.S. PATENT DOCUMENTS 8,579,023 B1 11/2013 Nish et al.
8,770,276 B1 7/2014 Nish et al.
(Continued)

OTHER PUBLICATIONS

PCT Application No. US2017/022515; International Search Report and Written Opinion of the International Searching Authority for Applicant Superior Energy Services, LLC dated Jul. 20, 2017.

*Primary Examiner* — Wei Wang
(74) *Attorney, Agent, or Firm* — Jones Walker LLP

(57) ABSTRACT

A downhole plug having a plug body which includes (i) a base cylinder with a first outward facing locking surface and a central bore formed there through, (ii) a single set of circumferentially spaced slip ramps formed on the base cylinder, and (iii) slip guides positioned between the slip ramps, the slip guides having a second inward facing locking surface. The plug includes a single set of slips which a plurality of slip wedges with each slip wedge engaging a slip ramp. A slip compression cap is configured to urge the slip wedges along the slip ramps and the slip compression cap includes a locking ring having a third outward facing locking surface. A compression shoulder is configured to move a ratchet ring into contact with the first locking surface on the base cylinder and the ratchet ring includes a fourth inward facing locking surface. A radially expandable seal assembly is positioned between the compression shoulder and the slip ramps, and a catch seat is configured to receive a droppable object and establish a flow blockage above the catch seat to fluid moving through the central bore in a direction from the catch seat to the compression cap.

20 Claims, 6 Drawing Sheets

(56) References Cited

U.S. PATENT DOCUMENTS

| | | | | |
|---|---|---|---|---|
| 2010/0132960 | A1 | 6/2010 | Shkurti et al. | |
| 2013/0186649 | A1* | 7/2013 | Xu | E21B 23/01 166/382 |
| 2014/0020911 | A1 | 1/2014 | Martinez | |
| 2014/0311752 | A1 | 10/2014 | Streich et al. | |
| 2016/0290095 | A1* | 10/2016 | Cromer | E21B 33/129 |

* cited by examiner

DISSOLVABLE PLUG ASSEMBLY

CROSS REFERENCE TO RELATED APPLICATION

This application claims the benefit under 35 U.S.C. § 119(e) of U.S. Provisional Application Ser. No. 62/309,225 filed on Mar. 16, 2016, which is incorporated by reference herein in its entirety.

FIELD OF INVENTION

The present invention relates to plug devices designed to temporarily block or isolate a portion of a wellbore during various operations which may be performed in oil and gas wells.

SUMMARY OF SELECTED EMBODIMENT OF INVENTION

A downhole plug having a plug body which includes (i) a base cylinder with a first outward facing locking surface and a central bore formed there through, (ii) a single set of circumferentially spaced slip ramps formed on the base cylinder, and (iii) slip guides positioned between the slip ramps, the slip guides having a second inward facing locking surface. The plug includes a single set of slips which a plurality of slip wedges with each slip wedge engaging a slip ramp. A slip compression cap is configured to urge the slip wedges along the slip ramps and the slip compression cap includes a locking ring having a third outward facing locking surface. A compression shoulder is configured to move a ratchet ring into contact with the first locking surface on the base cylinder and the ratchet ring includes a fourth inward facing locking surface. A radially expandable seal assembly is positioned between the compression shoulder and the slip ramps, and a catch seat is configured to receive a droppable object and establish a flow blockage above the catch seat to fluid moving through the central bore in a direction from the catch seat to the compression cap.

DESCRIPTION OF SELECTED EMBODIMENTS

The plug assembly of the present invention relates to tools used in oil and gas wells. When describing an "uphole" end of a tool, this indicates the end of the tool closer to the surface along the path of the wellbore, although not necessarily in the vertical direction since the wellbore may be horizontal. When describing a "downhole" end of the tool, this indicates the end of the tool closer to the bottom or toe of the wellbore along the path of the wellbore. Likewise, the "uphole direction" is toward the surface along the path of the wellbore and the "downhole direction" is toward the toe along the path of the wellbore.

Figure 1:
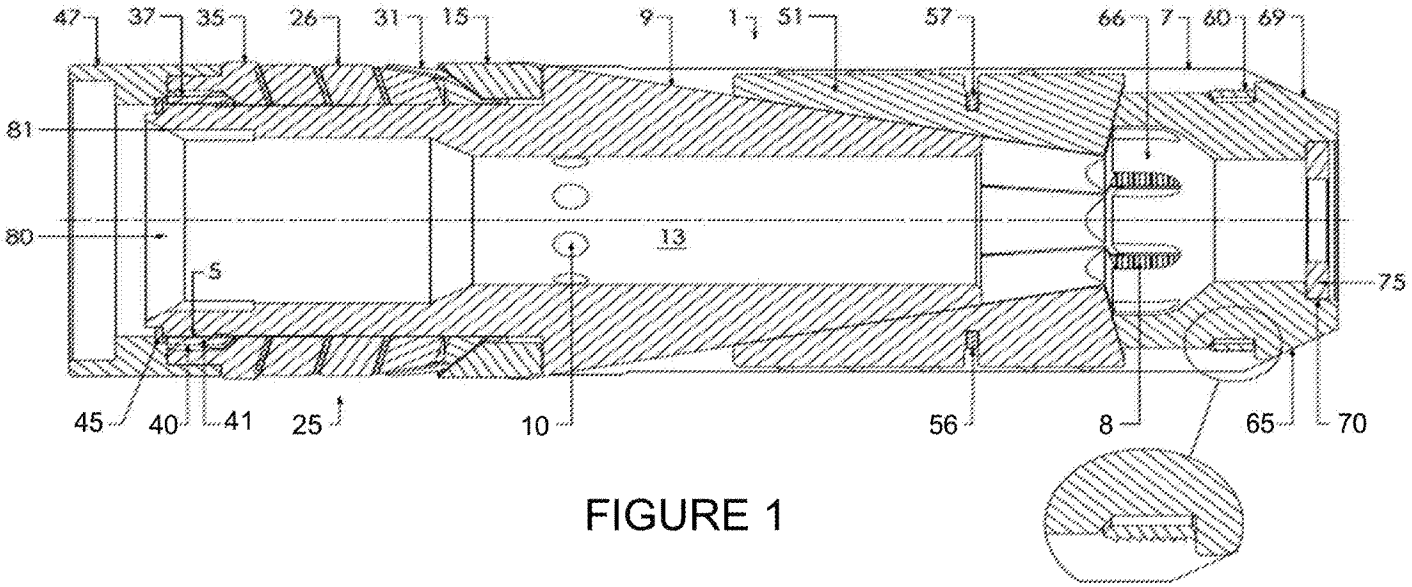
FIG. 1 is a cross-sectional view of one embodiment of the present invention.
Figure 2:
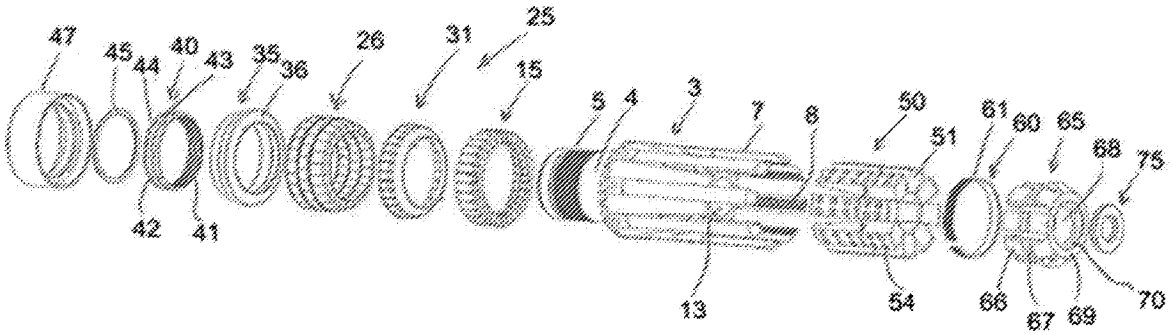
FIG. 2 is an exploded perspective view of the embodiment seen in FIG. 1.
Figure 6:
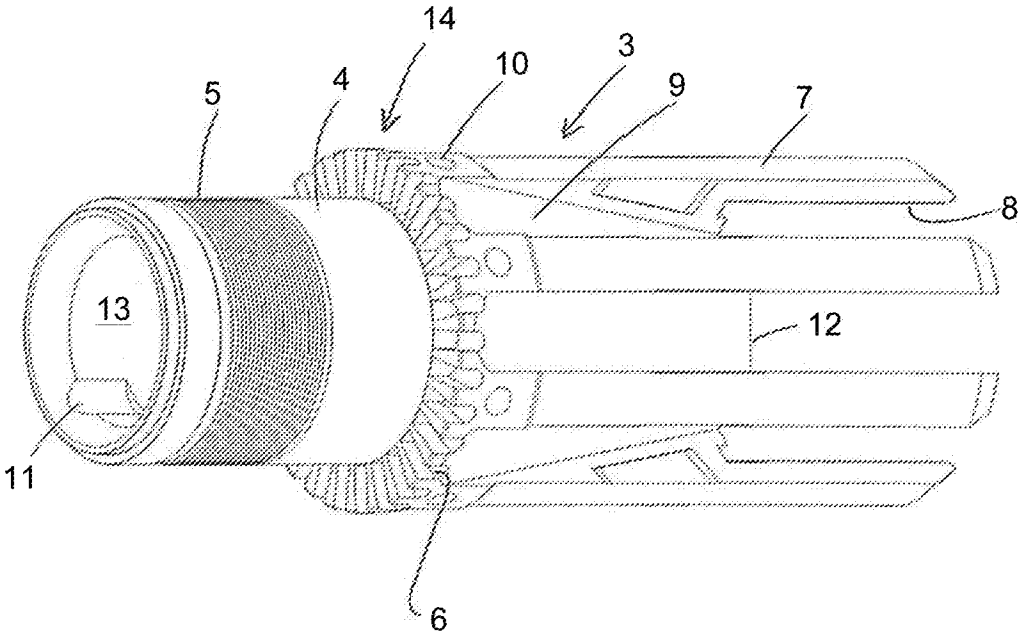
FIG. 6 is a perspective view of one embodiment of a plug body.

FIGS. 1 and 2 illustrate the various components of one embodiment of the plug assembly 1 of the present invention. More generally, this embodiment of the plug assembly 1 is formed of plug body 3, slips 50, slip compression cap 65, seal assembly 25, and compression shoulder ring 47. The details of plug body 3 are best seen with reference to FIG. 6 along with FIGS. 1 and 2. FIG. 6 illustrates how this embodiment of plug body 3 will have a base cylinder 4 with a central bore 13 extending through base cylinder 4. A series of circumferentially spaced slip ramps 9 are formed on the base cylinder 4. Slip ramps 9 reach their radially outermost position near the shoulder area 14 of plug body 3 and slope radially inward as ramps 9 extend away from shoulder area 14. Formed in between the slip ramps 9 are slip guides 7 which also extend away from shoulder area 14, but do so generally parallel to central bore 13, i.e., with no significant slope in the radial direction. A portion of the slip guides 7 extend past the distal end 12 of slip ramps 9 and this portion of the slip guides 7 include a series of radially inward facing locking teeth or grooves 8. The locking grooves 8 will cooperate with the slip lock ring 60 (see FIG. 2) as explained in more detail below. Although the illustrated embodiment shows the slip guides having radially inward facing locking grooves 8, alternate embodiments could include other conventional or future developed locking surfaces or locking mechanisms. For example an alternative locking surface could include lock/snap rings.

As suggested by the figures, slip guides 7 and slip ramps 9 generally originate at the shoulder area 14 on base cylinder 4. Additionally, a series of backup ring notches 6 are formed in shoulder area 14 and will cooperated with backup ring 15 as also described in more detail below. Further in the vicinity of shoulder area 14 are a series of flow apertures 10 which create a flow path from the external surface area of the plug assembly to central bore 13. Still viewing FIG. 6, positioned on the exterior surface of base cylinder 4 are a series of radially outward facing locking teeth or grooves 5 which will cooperate with the ratchet ring 40 (FIG. 2). Again, alternate embodiments could include other conventional or future developed locking surfaces or locking mechanisms in place of locking grooves 5. An anti-rotation slot 11 is formed on the inner surface of base cylinder 4 and will cooperate with the setting tool (as explained below).

In many embodiments, plug body 3 will be formed of a degradable material. As used herein, "degradable material" means a material that will lose structural integrity within reasonable time frame in the presence of a solvent, whether that solvent is naturally occurring in the wellbore or is introduced into the wellbore during drilling and/or completion operations. In many embodiments, the material will degrade in about 1 to about 7 days (after exposure to the solvent). However, particular applications might utilized materials degrading on time frames ranging from three hours to six months, including any sub-range of this time period, e.g., two weeks to two months. The degradable material may sometimes also be referred to as a "dissolvable material," but this does not typically imply dissolution on a molecular level. However, there could be embodiments where a "degradable material" does in fact dissolve down to the molecular level. The degradable material may be any number of materials including, but not limited to, degradable (or dissolvable) metals such as magnesium, aluminum (including alloys thereof), dissolvable polymeric materials, or other dissolvable polymers. One example of an acid dissolvable or "degradable" aluminum is aluminum 6061 T-6. Magnesium (Mg), either in elemental form or as an alloy, can serve as one preferred base material for the degradable material. Thus, the degradable material could be Mg alloys that combine other electrochemically active metals, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. These electrochemically active metals, including Mg, Al, Mn or Zn, or combinations thereof, may also include a rare earth element or combination of rare earth elements. As used herein, rare earth elements include Sc, Y, La, Ce, Pr, Nd, Fe, or Er, or a combination thereof. Where present, a rare earth element or combinations of rare earth elements may be present, by weight, in an amount of about 5% or less.

As a specific example, TervAlloy™ available from Terves, Inc. of Euclid, Ohio is a magnesium and aluminum nanocomposite disintegrating material designed to disintegrate (turn to powder) based on exposure to a controlled fluid (e.g., electrolyte), or an electrical or thermal stimuli. TervAlloy™ will disintegrate into very fine grained particles after a specified time in response to a controlled environmental stimulus. A wide range of solvents may be employed as long as they are capable of reducing the dissolving material without excessive corrosion of downhole tubulars and equipment. As nonlimiting examples, the solvent could be brines formed from NaCl, CaCl, NaBr, CaBr, caesium formates, sodium formates, etc. Likewise, the solvent could be any number of acids including various concentrations of hydrofluoric acid, hydrochloric acid, sulfuric acid, acetic acid, and other acids commonly used in the downhole environment. In one embodiment, the degradable material such as the above TervAlloy™ may be coated with a polymer that is unaffected by acids and brines found in the downhole environment where the material is to be used. When it is desired to remove the degradable material, a solvent effective against the polymer (e.g., hydrofluoric acid) is circulated to remove the polymer coating, thus exposing the TervAlloy™ to existing brines that will ultimately degrade it. The brine may be latent brine or additional brine which is circulated downhole.

FIGS. 1 and 2 suggest how the slip assembly 50 will engage slip ramps 9. The illustrated embodiment of slip assembly 50 is formed of a series of slip elements or slip wedges 51. As is well known in the art, the slip wedges 51 will have an inner angled surface generally complementary to slip ramps 9 and an outer surface configured to engage and grip the inner surface of steel casing or other tubular members typically used in oil and gas wells. In preferred embodiments, slip wedges 51 will also be formed of a degradable material. In the illustrated embodiment, the outer surface of slip wedges 51 will have a series of inserts or buttons 54 positioned thereon. These inserts or buttons are typically formed of a material encouraging a strong "bite" into the casing surface, e.g., 40 KSI grey cast iron (ASTM A48) and are less likely to be formed of a degradable material than the slip wedges themselves. FIG. 1 shows how a slip ring 56 (a broken ring segment) will engage groove 57 in slip wedges 51. Slip ring 56 will act as a biasing mechanism tending to hold slip wedges 51 inward toward the center of the plug assembly while in the unset or run-in position. However, as the slip wedges 51 advance up the slip ramps 9, slip ring 56 expands to allow the slip wedges 51 to move radially outwards. In certain embodiments, the length of the slip ramps is between about 20% and about 70% (or any range of percentages between 20% and 70%) of the distance between the upper end and the lower end of the downhole plug.

Still viewing FIGS. 1 and 2, positioned on the forward or downhole end of plug assembly 1 is the slip compression cap 65. In the illustrated version of slip compression cap 65, the compression cap is formed by a series of cap legs 66 extending from nose cone 69. A center aperture 68 is formed through nose cone 69 together with inset shoulder 70 to accommodate the main or release shear ring 75 (see FIG. 1 assembled view). Slip compression cap 65 will include slip ring groove 67 into which slip lock ring 60 is positioned. As suggested in FIG. 2, this example of slip lock ring 60 is a broken ring segment having a series of lock ring teeth or grooves 61 formed on its outer surface. FIG. 1 demonstrates how, in the assembled plug, the cap legs 66 of slip compression cap 65 will abut the downhole ends of slip elements 51 with the slip guides 7 sliding into the spaces between the cap legs 66. This will allow the externally facing teeth of slip lock ring 60 to engage the internally facing teeth of slip guides 7. As is conventionally known, the teeth 61 on slip lock ring 60 have a sloping rearward (uphole) face and a perpendicular forward (downhole) face. The teeth 8 on slip guides 7 have the opposite orientation of sloped and perpendicular faces. Thus, slip lock ring 60 may move in a rearward (uphole) direction relative to slip guides 7, but is blocked from moving in the opposite (downhole) direction.

Figure 5:
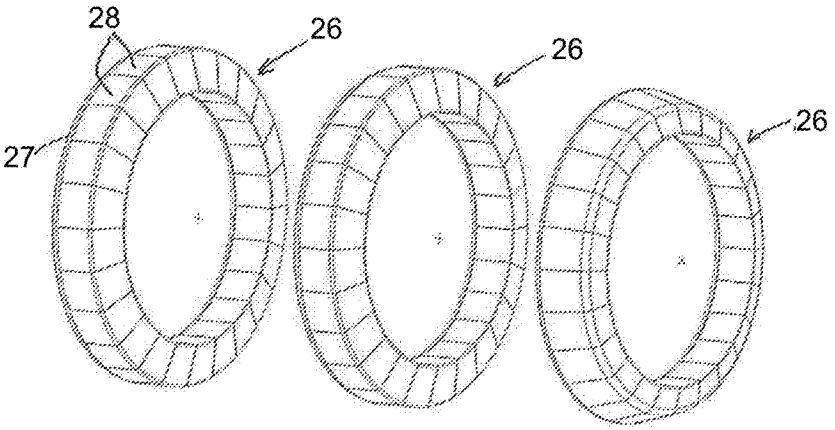
FIG. 5 is a perspective view of one embodiment of primary seal element rings.

A further main component of the plug assembly is a radially expandable seal assembly 25 which is positioned on base cylinder 4 of plug body 3. The illustrated embodiment of seal assembly 25 generally consists of a plurality of primary seal element rings 26 and a backup seal element ring 15. As better seen in FIG. 5, the primary seal element rings 26 are formed from a series of element pieces 28 bonded to a backing ring 27. In this embodiment, the element pieces 28 are formed from a rubber-like elastomeric material such as a nitrile rubber, but could be formed of any number of materials which suitably expand when compressed and which can withstand the conditions in the applicable wellbore environment. The backing ring is typically a dissolvable metal such as described above. Thus, it can be envisioned how upon dissolution of backing ring 27, the ring bodies 26 lose structural integrity even if the element pieces themselves are not of a degradable material. The FIG. 5 embodiment shows the rightmost element ring 26 as having a more conical shape. As described further below, this assists with the element ring engaging the petal backup ring mold 31.

Figure 4:
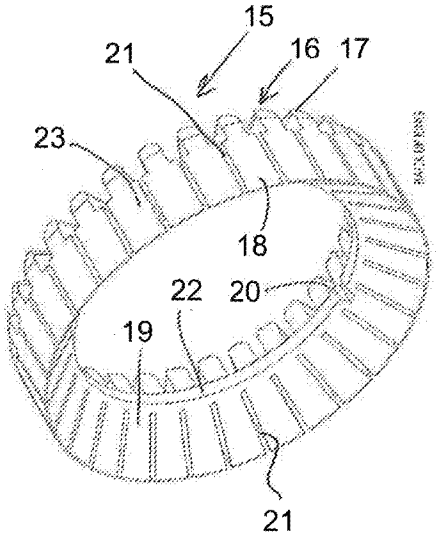
FIG. 4 is a perspective view of one embodiment of a backup seal element ring.

The embodiment of backup seal element ring 15 seen in FIG. 4 includes a ring body 16 having an inner conical surface 19 and an inner rim 22. A circumferential series of cuts 21 are made into the outer surface 23 of ring body 16 in order to form a plurality of individual ring elements 18. In the FIG. 4 embodiment, the individual ring elements 18 will have an element tongue 17 formed on the side opposing conical surface 19. It can be seen in FIG. 4 that the cuts 21 stop short of traversing rim 22, thus leaving a thin section of material which maintains ring elements in their ring configuration while backup ring 15 is in its unexpanded state. In the FIG. 4 embodiment, backup ring 15 is also formed of a degradable material, preferably one of the dissolvable metals described above.

Figure 3:
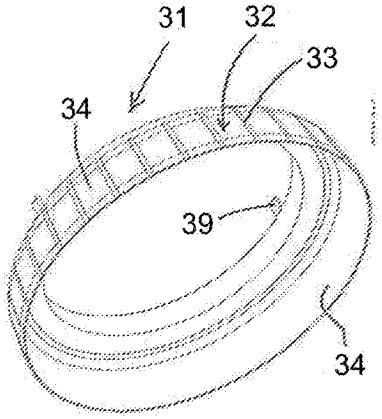
FIG. 3 is a perspective view of one embodiment of a petal backup ring mold.

Certain embodiments of seal assembly 25 include a petal backup ring mold 31 such as seen in FIG. 3. Petal backup ring mold 31 will have cup-shaped ring body 32 which is preferably formed of a dissolvable metal. The inner surface 34 of petal backup ring mold 31 is shaped to fit over the front facing (downhole facing) rightmost seal element ring 26 seen in FIG. 5. A circumferential series of cuts 33 will be made on, but not through the outer surface of ring body 32 in order to form a series of discrete segments or "petals" 34 which individually open upon expansion of petal backup ring mold 31. In the illustrated embodiment, the inner surface 34 of ring body 32 will be coated with an approximately 1 mm thick layer of an elastomer material such as hydrogenated nitrile butadiene rubber (HNBR). FIG. 3 further shows how this embodiment of petal backup ring mold 31 includes a plurality (two in FIG. 3) alignment tabs 39 which will engage the alignment notches 20 on backup ring 15. The alignment tabs 39 are positioned such that petals 34 and ring elements 18 of backup ring 15 will overlap in an offset manner as described further below.

Returning to FIG. 2, positioned on the uphole side of seal assembly 25 is ring housing 35. Ring housing 35 includes a downhole face 36 for engaging one of the primary seal element rings 26 and an internal shoulder 37 (see FIG. 1) for engaging ratchet ring 40. The illustrated embodiment of ratchet ring 40 is a broken ring formed by a ring shaped body with gap 42. Ratchet ring 40 includes an external circumferential center groove 43 which engages shoulder 37 of ring housing 35. Ratchet ring 40 further includes a series of detents 44 to provide the ring with additional flexibility for expanding and sliding over the ratchet grooves 5 on plug body 3. Thus, it can be envisioned how the outwardly facing ratchet grooves 5 on plug body 3 will be engaged by the inwardly facing ratchet teeth or grooves 41 on ratchet ring 40. Naturally, alternate embodiments could include other conventional or future developed locking surfaces or locking mechanisms in place of grooves 41.

As seen in FIG. 1, ring housing 35 is secured on base cylinder 4 of plug body 3. As ring housing 35 moves over base cylinder 4 into engagement with seal assembly 25, the ratchet teeth 41 on ratchet ring 40 will engage ratchet teeth/grooves 5 on base cylinder 4. Similar to slip lock ring 60, but in a reverse orientation, the ratchet teeth 41 on ratchet ring 40 have a sloping forward (downhole) face and a perpendicular rearward (uphole) face. The ratchet teeth 5 on base cylinder 4 have the opposite orientation of sloped and perpendicular faces. Thus, ratchet ring 40 may move in a forward (downhole) direction, but is blocked from moving in the opposite (uphole) direction. The upper most plug component shown in FIGS. 1 and 2, guide ring or compression shoulder ring 47, will have internal threads (not shown) which engage external threads (not shown) on ring housing 35 such that compression shoulder ring 47 may shoulder up against ring housing 35 in the plug's assembled state. As seen in FIG. 1, the activation shear ring 45 is positioned between an internal shoulder on compression shoulder ring 47 and an external shoulder on base cylinder 4.

Figure 7A:
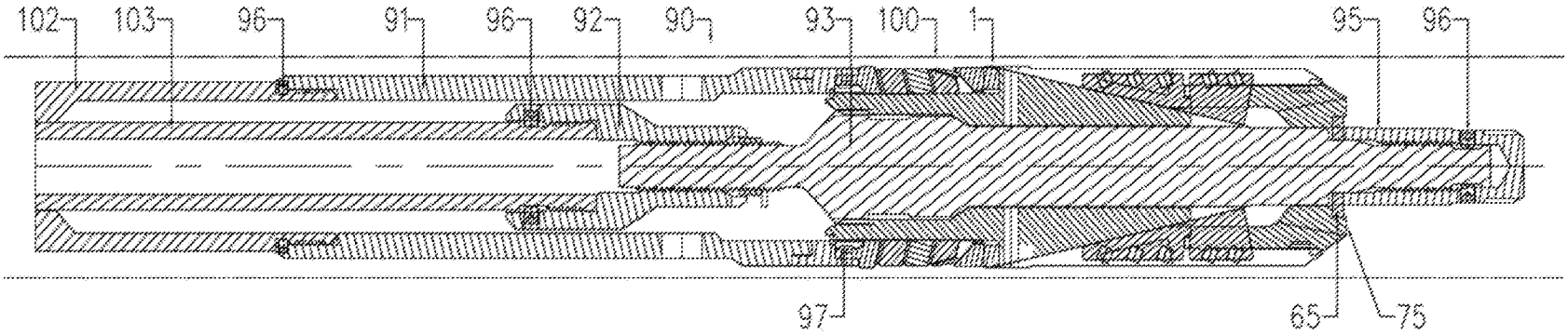
FIG. 7A is a cross-sectional view of a setting tool engaging the FIG. 1 plug in the run-in position.
Figure 7B:
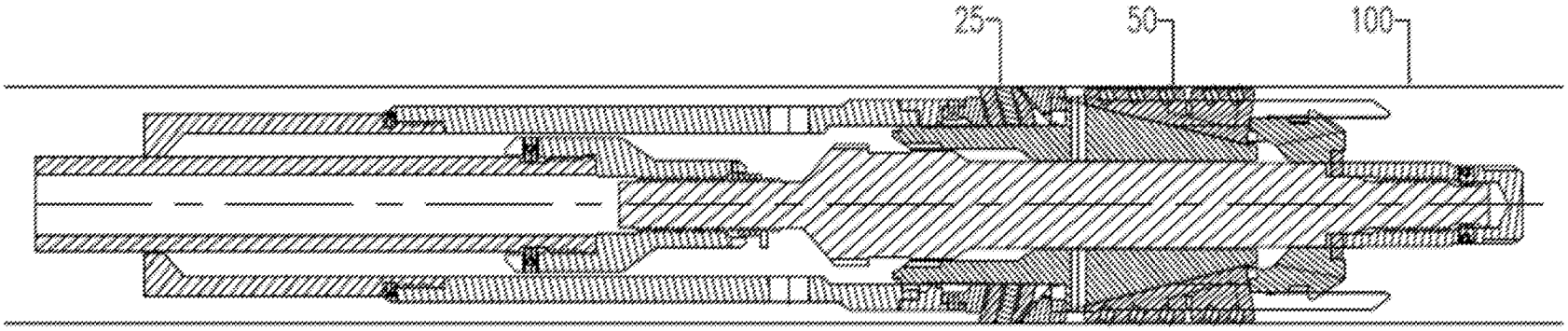
FIG. 7B is a cross-sectional view of a setting tool engaging the FIG. 1 plug in the set position.

The deployment and operation of plug assembly 1 is best understood in reference to FIGS. 7A and 7B. FIG. 7A shows plug assembly 1 in the run-in, unset position within cased wellbore 100. Furthermore, plug assembly 1 is shown joined with setting tool 90. In the illustrated embodiment, setting tool 90 generally comprises the main setting rod 93, adapter 92, and setting sleeve 91. Main setting rod 93 extends through the central bore of plug assembly 1 with the threaded nose of setting rod 93 extending through the center aperture 68 of compression cap 65 and release shear ring 75. It will be understood that the setting rod cap 95 is only threaded onto the nose of setting rod 93 after the nose has extended through compression cap 65. In other words, setting rod cap 95 fixes setting rod 93 within the plug's central bore as long as release shear ring 75 remains intact. The anti-rotation splines 97 on setting rod 93 will engage the anti-rotation slots 11 on plug body 3 (see FIG. 6) and the uphole end of setting rod 93 threads into adapter 92. The setting sleeve 91 is threaded into compression shoulder ring 47 and the various threaded connections in FIG. 7A are shown as secured with set screws 96. Mechanical force is provided to setting tool 90 by the differential movement of outer activing sleeve 102 engaging setting sleeve 91 and inner activing sleeve 103 engaging adapter 92. The outer activating sleeve 102 and inner activating sleeve 103 may part of any conventional or future developed downhole setting apparatus. In one preferred embodiment, plug assembly 1 will be deployed on wireline with outer activating sleeve 102 and inner activating sleeve 103 forming part of a pressure activated setting apparatus, such as the Baker Hughes E-4™ #20 wireline pressure setting assembly.

In the wireline delivery example, the plug assembly 1, in the run-in position of FIG. 7A, is lowered to the desired setting depth in a cased wellbore. To set plug assembly 1, the setting apparatus will be activated to impart a differential setting force between outer activating sleeve 102 and inner activating sleeve 103, e.g., a downward force on outer activating sleeve 102 and an upward force on inner activating sleeve 103. This force will initially be sufficient to cause setting shear ring 45 to fail, as one nonlimiting example, at approximately 12,000 lbs. However, because release shear ring 75 has a much higher rating (for example, approximately 25,000 lbs.), continued upward force by inner activating sleeve 103 is transferred through setting rod 93 to slip compression cap 65. The legs 66 of slip compression cap 65 transfer this upward force to the downhole ends of slip elements 51. This causes the slip elements 51 to move up the slip ramps 9 and to expand radially outward into engagement with the inner casing wall, i.e., to transition to the set position for slip assembly 50. As slip compression cap 65 moves toward the plug body 3, the slip lock ring 60 carried by slip compression cap 65 continues to slide past the teeth or grooves 8 on the slip guides 7 (i.e., the sloped faces of the teeth can slide past one another). Once slip assembly 50 is fully set against the inner casing wall by the upward movement of compression cap 65, the locking of the teeth on slip lock ring 60 and teeth 8 on slip guides 7 (i.e., the engagement of their vertical faces) will prevent slip assembly 50 from releasing, even after upward force is removed from slip compression cap 65.

Figure 9:
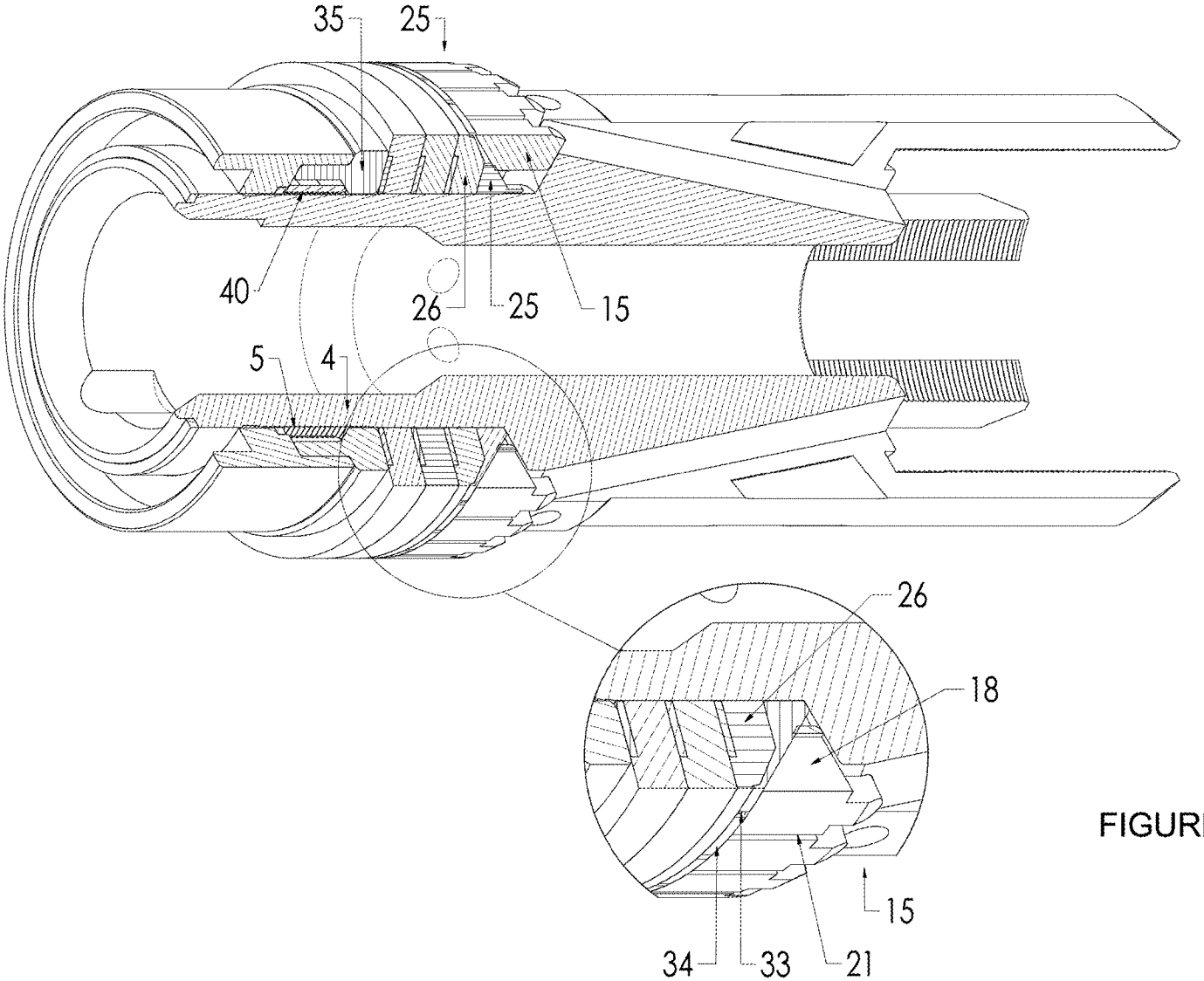
FIG. 9 is a perspective view of the FIG. 1 seal elements in the set position.
Figure 8:
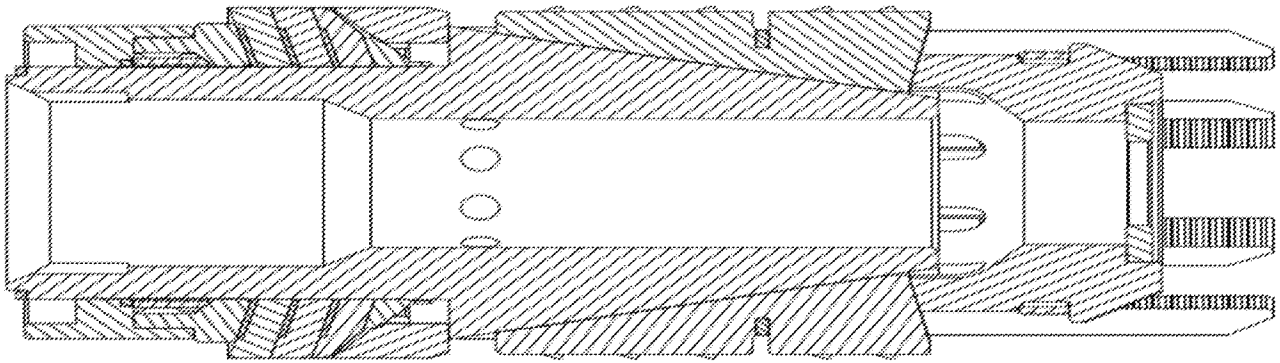
FIG. 8 is a cross-section view of the FIG. 1 plug in the set position.

With slip assembly 50 fully set, continued differential force on outer/inner activating sleeves 102/103 will apply increasing compressive force on seal assembly 25 between compression shoulder ring 47 and shoulder area 14 of plug body 3. This compressive force will cause the elements of seal assembly 25 to expand radially and ultimately come into tight contact with the inner wall of the casing 100 as suggested in FIG. 7B. FIG. 8 shows plug assembly 1 in the set state and FIG. 9 shows a sectional view of seal assembly 25 in the set state. FIG. 9 suggests how backup ring 15 and petal backup ring mold 31 will begin sliding up on the lead seal element ring 26 until the individual ring elements 18 have also expanded radially into contact with the inside surface of the casing. In this process, the thin section of material at rim 22 of backup ring 15 (see FIG. 4) fails and the individual ring elements 18 separate, although the ring element's relative position is largely maintained by the element tongues 17 engaging the notches 6 on plug body. As seen in the enlarged insert of FIG. 9, the spacing of individual ring elements, i.e., ring elements 18 of backup ring 15 and petal segments 34 of petal backup ring mold 31, are staggered or offset such that the cuts 33 between petal segments 34 do not lay directly over the cuts 21 between ring elements 18. This offsetting of cuts 33 and 21 will tend to break up potential paths for fluid and fine particulates to move past the expanded backup ring 15.

It may also be readily seen in FIG. 9 how ratchet ring 40 positioned within ring housing 35 is able to move over the teeth/grooves 5 on base cylinder 4 in the direction toward seal assembly 25. As described above, ratchet ring 40 is able to move over teeth/grooves 5 toward seal assembly 25, but not in the reverse direction. Thus, ratchet ring 40 holds ring housing 35 against seal assembly 25, maintaining seal assembly 25 in its set, radially expanded state, even when the differential force supplied by outer/inner activating sleeves 102/103 is removed.

Figure 10:
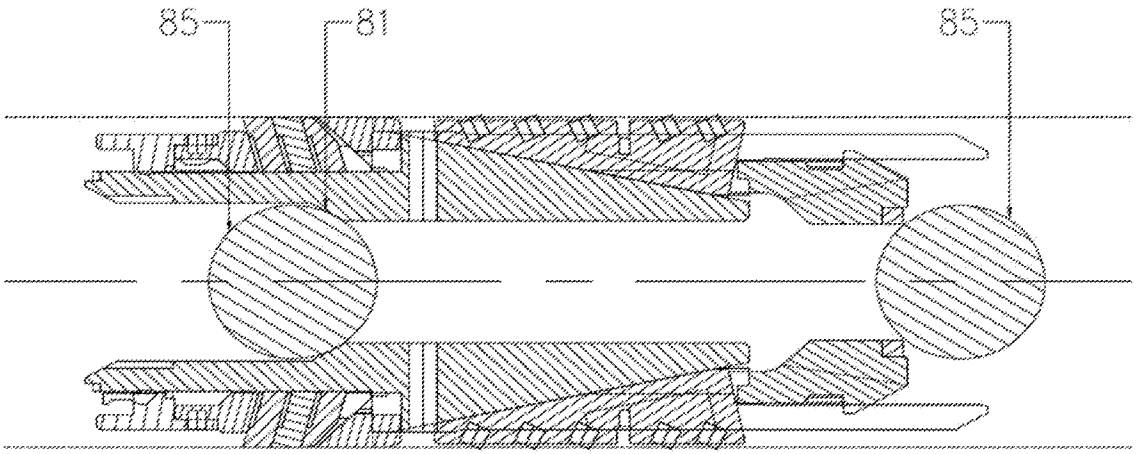
FIG. 10 is a cross-sectional view of a ball engaging the catch seat of the plug.

In order to disengage plug assembly 1 from setting tool 90, a sufficient upward force is applied to the setting tool such that release shear ring 75 fails, allowing setting rod cap 95 to be withdrawn through the central bore of plug assembly 1. Thereafter, when it is desired to isolate the portion of the wellbore below plug assembly 1 from an increase in pressure above plug assembly 1, a ball 85 as suggested in FIG. 10 (or another droppable object such as a dart) will be released from the surface and allowed to travel down the wellbore until coming to rest on catch seat 81 within plug body 3. This effectively blocks the plug assembly's central bore 13 and allows pumping or other activities to increase wellbore fluid pressure above the plug assembly for hydraulic fracturing or other procedures. In many embodiments, ball 85 is also formed of a degradable material.

In the embodiment illustrated, plug assembly 1 only acts to block fluid flow through the plug assembly in the uphole to downhole direction. If fluid flow is in the opposite direction (reverse flow), the upper ball 85 will tend to be dislodged from catch seat 81. It is also envisioned that balls from earlier operations or other tools could be below plug assembly 1. In a reverse flow situation, it could happen that a ball 85 engages the central aperture 68 of slip compression cap 65. However, this should not significantly obstruct flow through plug assembly 1. This is because significant flow paths are formed in the plug assembly between the compression cap and the seal assembly. For example, paths between the cap legs 66, or between the slip elements 51 and slip guides 7, or simply through the flow apertures 10 in plug body 3. Thus, even when the compression cap center aperture is blocked, no substantial pressure differential can be established between the plug body's central bore and an annular space surrounding the plug (and below the seal assembly 25).

The above embodiments describe certain plug components as being formed of a degradable material. In many embodiments, all or virtually all of the plug components will be formed of the same or different degradable materials. For example, in one embodiment, every component but the seal element pieces 28 are formed of a degradable material. However, there could be embodiments where only the component(s) necessary for the plug to release need to be of degradable materials, e.g., the plug body or even only certain portions of the plug body.

As used herein, the term "about" or "approximately" applies to all numeric values, whether or not explicitly indicated. These terms generally refer to a approximations that may vary by (+) or (−) 20%, 15%, 10%, 5%, or 1%. In many instances these terms may include numbers that are rounded to the nearest significant figure. Likewise, "substantially" means approximately all or 80%, 85%, 90%, or 95% or the quantity or parameter modified by that term.

Also, the above embodiments discuss the plug assembly being delivered by wireline. However, the plug could also be delivered by any conventional or future developed method, including coil tubing or discrete pipe segment strings. Although the disclosed embodiments describe the plug assembly positioned such that he seal assembly is uphole of the slips, there could be situations where the orientation of the plug is reversed. And while the particular embodiment illustrated take the form of a frac plug, the concepts of the present invention could be employed in other plugs or plug-type devices such as bridge plugs, packers, cement retainers, etc.

The invention claimed is:

1. A downhole plug comprising:

a. a plug body including:
   i. a base cylinder having radially outward facing locking grooves and a central bore formed there through,
   ii. a single set of circumferentially spaced slip ramps formed on the base cylinder,
   iii. slip guides positioned between the slip ramps, the slip guides having radially inward facing locking grooves;

b. a single set of slips, the set of slips including a plurality of slip wedges with each slip wedge engaging one of the slip ramps;

c. a slip compression cap configured to urge the slip wedges along the slip ramps, the slip compression cap including a locking ring having radially outward facing locking grooves;

d. a compression shoulder configured to move a ratchet ring into contact with the locking grooves on the base cylinder, the ratchet ring including radially inward facing locking grooves;

e. a radially expandable seal assembly positioned between the compression shoulder and the slip ramps; and f. a catch seat configured to receive a droppable object and establish a flow blockage above the catch seat to fluid moving through the central bore in a direction from the catch seat to the compression cap.

2. The downhole plug of claim 1, wherein the seal assembly further comprises a plurality of primary seal element rings and a backup seal element ring.

3. The downhole plug of claim 2, wherein the primary seal element rings include a dissolvable metal backing ring and a series of elastomer seal pieces bonded to the backing ring.

4. The downhole plug of claim 3, wherein the backup seal element ring comprises a ring of dissolvable metal, the ring including (i) a conical inner surface, (ii) a circumferentially space, radially extending series of cuts to form a series of backup elements, (iii) an uncut inner joiner section retaining the backup elements in a ring configuration, and (iv) an insertion tongue formed on a plurality of the backup elements.

5. The downhole plug of claim 4, wherein the plug body includes a series of backup ring notches which are engaged by the insertion tongues on the backup elements.

6. The downhole plug of claim 1, wherein the plug body includes a plurality of flow apertures positioned between the seal assembly and the compression cap, the flow apertures providing a fluid path from the central bore to an outer surface of the plug body.

7. The downhole plug of claim 1, wherein the compression cap includes a center aperture and sufficient flow paths are formed in the plug between the compression cap and the seal assembly such that when the compression cap center aperture is blocked, no substantial pressure differential can be established between the plug body's central bore and an annular space surrounding the plug below the seal assembly.

8. The downhole plug of claim 1, wherein the catch seat is positioned proximate the seal assembly.

9. The downhole plug of claim 8, wherein the seal assembly surrounds the catch seat.

10. The downhole plug of claim 1, wherein the slip ramps and the slip guides extend from a common shoulder, the slip ramps sloping radially inward and the slip guides extending past the slip ramps, the slip guides extending in a direction substantially parallel to one another.

11. The downhole plug of claim 1, further comprising a first shear ring positioned on the slip compression cap and a second shear ring positioned between the seal assembly and the compression shoulder, the first and second shear rings failing at significantly different magnitudes of force.

12. The downhole plug of claim 11, wherein the first shear ring fails at a higher magnitude of force than the second shear ring.

13. The downhole plug of claim 1, wherein the set of slips is configured to resist a greater force in a downhole direction than in an uphole direction.

14. The downhole plug of claim 1, wherein a slope of the slip ramps is oriented such that the set of slips exert greater outward radial force on a casing wall as a downward force is exerted on the plug assembly.

15. The downhole plug of claim 1, wherein a setting tool (i) engages the slip compression cap and the compression shoulder; and (ii) is configured to transmit a differential force between the slip compression cap and compression shoulder.

16. The downhole plug of claim 1, wherein the slip ramps have a single continuous slope.

17. The downhole plug of claim 1, wherein a length of the slip ramps is between about 20% and about 70% of a distance between an upper end of the compression shoulder and a lower end of the slip compression cap.

18. The downhole plug of claim 1, wherein the plug body and the slips are formed of a dissolvable metal.

19. A downhole plug comprising:

a. a plug body including:
   i. a base cylinder having a first outward facing locking surface and a central bore formed there through,
   iii. a single set of circumferentially spaced slip ramps formed on the base cylinder,
   iii. slip guides positioned between the slip ramps, the slip guides having a second inward facing locking surface;

b. a single set of slips, the set of slips including a plurality of slip wedges with each slip wedge engaging one of the slip ramps;

c. a slip compression cap configured to urge the slip wedges along the slip ramps, the slip compression cap including a locking ring having a third outward facing locking surface;

d. a compression shoulder configured to move a ratchet ring into contact with the first locking surface on the base cylinder, the ratchet ring including a fourth inward facing locking surface;

e. a radially expandable seal assembly positioned between the compression shoulder and the slip ramps; and f. a catch seat configured to receive a droppable object and establish a flow blockage above the catch seat to fluid moving through the central bore in a direction from the catch seat to the compression cap.

20. The downhole plug of claim 19, wherein the first locking surface includes radially outward facing locking grooves, the second locking surface includes radially inward facing locking grooves, and the third locking surface includes radially outward facing locking grooves.

* * * * *